US008651897B2

(12) United States Patent
Chen et al.

(10) Patent No.: US 8,651,897 B2
(45) Date of Patent: Feb. 18, 2014

(54) USB DEVICE WITH SOLDERLESS CONNECTOR INTERFACE

(75) Inventors: Ben Wei Chen, Fountain Valley, CA (US); Chin-Tang Yen, Zhubei (TW); Ke-Chun Chou, Hsinchu (TW)

(73) Assignee: Kingston Digital, Inc., Fountain Valley, CA (US)

( * ) Notice: Subject to any disclaimer, the term of this patent is extended or adjusted under 35 U.S.C. 154(b) by 5 days.

(21) Appl. No.: 13/523,575

(22) Filed: Jun. 14, 2012

(65) Prior Publication Data

US 2013/0337701 A1 Dec. 19, 2013

(51) Int. Cl.
*H01R 24/00* (2011.01)

(52) U.S. Cl.
USPC ..... 439/660

(58) Field of Classification Search
USPC ..... 439/660, 188
See application file for complete search history.

(56) References Cited

U.S. PATENT DOCUMENTS

| | | | | |
|---|---|---|---|---|
| 7,021,971 | B2 * | 4/2006 | Chou et al. | 439/660 |
| 7,128,671 | B2 * | 10/2006 | Gu et al. | 474/23 |
| 8,480,435 | B2 * | 7/2013 | Hsiao et al. | 439/660 |
| 2011/0053414 | A1 | 3/2011 | Wan et al. | |

FOREIGN PATENT DOCUMENTS

| | | |
|---|---|---|
| CN | 202019065 | 10/2011 |
| CN | 202308396 | 7/2012 |

* cited by examiner

*Primary Examiner* — Phuong Dinh
(74) *Attorney, Agent, or Firm* — Sawyer Law Group, P.C.

(57) ABSTRACT

The present invention includes a USB3 device with solderless USB3 connector interfaces, which comprises: a USB3 device main body that houses a carrier body made of rigid material; four interface pins in the outer row that conform to the USB2.0 standard; five interface pins in the inner row that conform to the USB3.0 standard; and a substrate and electronic circuitry; and a USB3 device sub-body that houses: a carrier body made of rigid material; and five interface pins that conform to the USB3.0 standard wherein each interface pin has an upper convex part and a lower concave part; the upper convex part and the lower concave part forms a spring coil pin; and the spring coil pin can withstand multiple times of compression; a top casing; a bottom casing; and a case assembly.

9 Claims, 10 Drawing Sheets

USB2.0 HOST CONNECTOR

USB2.0 DEVICE

USB3.0 HOST CONNECTOR

USB3.0 DEVICE

USB DEVICE WITH SOLDERLESS CONNECTOR INTERFACE

FIELD OF THE INVENTION

The present invention relates generally to computing devices and more particularly to a USB device utilized with such computing devices.

BACKGROUND OF THE INVENTION

The USB host and device are ubiquitous in computing devices including PC, Notebook, Server, Tablet PC, smart TV, media player, gaming machine and peripheral devices. USB3.0 (USB3) interface standard is introduced as the successor to the ever successful USB2.0 (USB2) interface standard. USB3 is aimed to deliver 10 times the performance while maintaining the backward compatibility with USB2. A USB3 device connector traditionally has a total of nine external interface pins, with one row of four and one row of five pins, connecting to a USB3 device through surface mount technology (SMT) or through hole technology. The physical dimension of the USB3 device connector therefore adds length to the size of the USB3 device. If the USB3 device can extend the body of the USB3 device to where the front edge of the USB3 device connector is and achieve the functionality of the USB3 device connector in its main body, it not only eliminates the need for a physical USB3 device connector and saves cost, but also accommodates more real estate or space for the circuitry inside the USB3 device. The challenge lies in how to effectively achieve the functionality of a USB3 device connector in the main body of the USB device.

The USB3 host connector introduces five more pins in addition to the original four pins of USB2 host connector. Most USB3 devices require a USB3 device connector that is soldered to a substrate or a PCB in order to securely mate to the USB3 host connector or the USB2 host connector. The two rows of four pins and five pins in the USB3 device connector are mated to the two rows of four pins and five pins correspondingly, in the USB3 host connector. In the case of the USB2 host connector, only the outer row of 4 pins is used in the USB3 device connection to connect. In the situation where the USB3 flash storage device is pre-fabricated in the molding process, the additional reflow soldering process of the USB3 device connector not only complicates the manufacturing but also introduces a low yield to the flash storage in the pre-fabricated USB device.

It is therefore advantageous to come up with a solderless USB3 connector and apparatus for the USB device to eliminate the soldering reflow, simplify the manufacturing process and to increase the yield of the USB3 device.

The physical difference between USB2 and USB3 host connectors is depicted in FIGS. 1A and 1B. The cross section view of one of the pins 13 of the USB2 host connector 111 is shown in FIG. 1A. The cross section view of one of the pins 103, of the USB3 host connector 113 is shown in FIG. 1B. A USB2 device connector 112 may be plugged into a USB2 host connector 111 or a USB3 host connector 113. Likewise, a USB3 device connector 114 may be plugged into a USB2 host connector 111 or a USB3 host connector 113.

As shown in FIG. 1A, a USB2 host connector 111 has a top casing 10 and a bottom casing 11. It also has a main body 12 that houses the four interface pins (not shown). One of the pins 13 in the USB2 host connector 111 is shown in a cross section view. The pin 13 is retractable and will recede upward into the USB2 host main body 12 when the main body 17 of the USB2 device is plugged in. A USB2 device connector 112 has a top casing 14, a bottom casing 15, a main body 17, an optional stopper 18 and four interface pins (not shown). One of the pins 16 in the USB2 device connector 112 is shown in a cross section view. The pin 16 will not recede when the USB2 device connector 112 is plugged into the USB2 host connector 111. Its counterpart pin 13 in USB2 host connector 111 will recede and connect to pin 16 when the USB2 device connector 112 is fully plugged into the USB2 host connector 111.

As shown in FIG. 1B, a USB3 host connector 113 has a top casing 100 and a bottom casing 101. It also has a main body 102 that houses the four interface pins (not shown) in the inner row and five interface pins (not shown) in the outer row. One of the pins 103 on the inner row is shown in a cross section view. One of the pins 110 on the outer row is also shown in a cross section view. The pin 103 is retractable and will recede upward into the USB3 host main body 102 when the USB3 device connector 114 is fully plugged in.

A USB3 device connector 114 has a top casing 104, a bottom casing 105, a main body 107, an optional stopper 108 and four interface pins (not shown) in the outer row and five interface pins (not shown) in the inner row. One of the pins 106 in the USB3 device connector 114 is shown in a cross section view. The pin 106 will not recede when the USB3 device connector 114 is plugged into the USB3 host connector 113. Its counterpart 103 on USB3 host connector 113 will recede and connect to pin 106 when the USB3 device connector 114 is fully plugged into the USB3 host connector 113. One of the pins 109 in the USB3 device connector 114 is shown in a cross section view. The pin 110 in the USB3 host connector 113 will not recede when the USB3 device connector 114 is plugged into the USB3 host connector 113. Its counterpart pin 109 in the USB3 device connector 114 will recede and connect to pin 110 when the USB3 device connector 114 is fully plugged into the USB3 host connector 113.

When the USB3 device connector 114 is fully plugged into the USB2 host connector 111, the pin 106 of the USB3 device connector 114 is connected to the pin 13 of the USB2 host connector 111. The pin 109 in the USB3 device connector 114 will recede and will not make contact with any other pin in the USB2 host connector 111.

As shown in FIG. 2A, FIG. 2B and FIG. 20, a USB3 host connector 113 has a top casing 100 and a bottom casing 101. It also has a main body 102 that houses the four interface pins (not shown) in the inner row and five interface pins (not shown) in the outer row. One of the pins 103 in the inner row is shown in a cross section view. One of the pins 110 in the outer row is shown in a cross section view. The pin 103 is retractable and will recede upward into the USB3 host main body 102 when the main body 107 of the USB3 device is plugged in.

FIG. 2A is a connection that tries to address the challenge of effectively achieving the functionality of USB device connector in a main body of the USB device. As in FIG. 2A, a USB3 device 220 has a top casing 24, a bottom casing 25, a main body 27, and a surface mountable sub-body 21. The main body 27 and the sub-body 21 are connected through surface mount technology.

The main body 27 houses four interface pins (not shown) in the first row and five interface pins (not shown) in the fourth. Two of the pins 26 (in the first row) and 23 (in the fourth row) on the USB3 device main body 27 are shown in a cross section view.

The surface mountable sub-body 21 houses five interface pins (not shown) in the second row and five interface pins (not shown) in the third row. The second row pins and the third row pins are connected in pairs internally inside the sub-body 21.

Two of the pins 20 (in the second row) and 22 (in the third row) in the USB3 sub-body 21 are shown in a cross section view. Pin 20 and pin 22 are connected internally inside USB3 sub-body 21.

The pin 26 will not recede when the USB3 device 220 is plugged into the USB3 host connector 113. Its counterpart 103 in USB3 host connector 113 will recede and connect to pin 26 when the USB3 device 220 is fully plugged into the USB3 host connector 113.

The pin 110 in USB3 host connector 113 will not recede when the USB3 device 220 is plugged into the USB3 host connector 113. Its counterpart pin 20 on USB3 sub-body 21 will also not recede but will also connect to pin 110 when the USB3 device 220 is fully plugged into the USB3 host connector 113. The reason pin 20 will not recede is that the sub-body 21 and the main body 27 are two separate rigid pieces. There is no room for pin 20 to recede when the USB3 device 220 is plugged into the USB3 host connector 113.

This embodiment achieves the benefits of eliminating an external USB3 device connector and accommodates more real estate or space for the circuitry inside the USB3 device. But it still requires soldering of the USB3 device sub-body 21 to the main body 27. And because the pin 20 would not recede after the USB3 device 220 is plugged into the USB3 host connector 113, it sustains stress to the structure of the pin. The impedance of the contact between pin 20 in USB3 device 220 and pin 110 in USB3 host connector starts to change as time progressing. The contact eventually becomes unstable and unreliable.

The embodiment as shown in FIG. 2B, intends to address the same challenge as above. It not only eliminates the need for a physical USB3 device connector and saves cost but also accommodates more real estate or space for the circuitry inside the USB3 device.

As shown in FIG. 2B, a USB3 device 221 has a top casing 204, a bottom casing 205, a main body 207, and a detachable sub-body 201. The main body 207 and the detachable sub-body 201 are connected through forced contact between five pairs of pins. One pin 200 of the pair is from the sub-body while another pin 203 is from the main body. Pin 200 is connected to pin 202 internally inside sub-body 201. No soldering between the two pins, 200 and 203, is required.

The main body 207 houses four interface pins (not shown) in the first row and five interface pins (not shown) in the fourth row. Two of the pins 206 (in the first row) and 203 (in the third row) in the USB3 main body 207 are shown in a cross section view.

The detachable sub-body 201 houses five interface pins (not shown) in the second row and five interface pins (not shown) in the third row. The second row pins and the third row pins are connected in pairs internally inside the sub-body 201. Two of the pins 200 (in the second row) and 202 (in the fourth row) in the USB3 sub-body 201 are shown in a cross section view. Pin 200 and pin 202 are connected internally inside USB3 sub-body 201.

The pin 206 will not recede when the USB3 device 221 is plugged into the USB3 host connector 113. Its counterpart 103 in USB3 host connector 113 will recede and will connect to pin 206 when the USB3 device 221 is fully plugged into the USB3 host connector 113.

The pin 110 in USB3 host connector 113 will not recede when the USB3 device 221 is plugged into the USB3 host connector 113. Its counterpart pin 200 on USB3 sub-body 201 also will not recede but will still connect to pin 110 when the USB3 device 221 is fully plugged into the USB3 host connector 113. The reason pin 200 will not recede is that the sub-body 201 and the main body 207 are two separate rigid pieces. There is no room for pin 200 to recede when the USB3 device 221 is plugged into the USB3 host connector 113.

This prior art achieves the benefits of eliminating an external USB3 device connector and accommodates more real estate or space for the circuitry inside the USB3 device. It also eliminates soldering of the USB3 device sub-body 201 to the main body 207. But because the pin 200 would not recede after the USB3 device 221 is plugged into the USB3 host connector 113, it sustains stress to the structure of the pin. The impedance of the contact between pin 200 in USB3 device 221 and pin 110 in USB3 host connector starts to change as time progresses. The contact eventually becomes unstable and unreliable. The contact between pin 202 in the USB3 sub-body and pin 203 in the USB3 main body would also become unstable and unreliable, due to the constant stress pressing between the pair of pins. The contact may also be weakened by the lever effect asserted by the force pressing against pin 200 when the USB3 device 221 is plugged into the USB3 host connector 113.

Another prior art, as shown in FIG. 2C, is a derivative of the prior art in FIG. 2B. Again it not only eliminates the need for a physical USB3 device connector and saves cost but also accommodates more real estate or space for the circuitry inside the USB3 device. It also has a detachable sub-body 211 that requires no soldering to the main body 217. By eliminating the third row pins in the sub-body 211, it further saves cost compared with that of the prior art in shown in FIG. 2B.

As shown in FIG. 20, a USB3 device 222 has a top casing 214, a bottom casing 215, a main body 217, and a detachable sub-body 211. The main body 217 and the detachable sub-body 211 are connected through forced contact between five pairs of pins. One pin 210 of the pair is from the sub-body 211 while another pin 213 is from the main body 217.

The main body 217 houses four interface pins (not shown) in the first row and five interface pins (not shown) in the fourth row. Two of the pins 216 (in the first row) and 213 (in the third row) on the USB3 main body 217 are shown in a cross section view.

The detachable sub-body 211 houses five interface pins (not shown) in the second row. One of the pins 210 (in the second row) on the USB3 sub-body 211 is shown in a cross section view.

The pin 216 will not recede when the USB3 device 222 is plugged into the USB3 host connector 113. Its counterpart 103 in USB3 host connector 113 will recede and connect to pin 216 when the USB3 device 222 is fully plugged into the USB3 host connector 113.

The pin 110 in USB3 host connector 113 will not recede when the USB3 device 222 is plugged into the USB3 host connector 113. Its counterpart pin 210 on USB3 sub-body 211 also will not recede but will still connect to pin 110 when the USB3 device 222 is fully plugged into the USB3 host connector 113. The reason pin 210 will not recede is that the sub-body 211 and the main body 217 are two separate rigid pieces. There is no room for pin 210 to recede when the USB3 device 222 is plugged into the USB3 host connector 113.

This embodiment achieves the benefits of eliminating an external USB3 device connector and accommodates more real estate or space for the circuitry inside the USB3 device. It also eliminates soldering of the USB3 device sub-body 211 to the main body 217. But because the pin 210 would not recede after the USB3 device 222 is plugged into the USB3 host connector 113, it sustains stress to the structure of the pin. The impedance of the contact between pin 210 in USB3 device 222 and pin 110 in USB3 host connector starts to change as time progresses. The contact eventually becomes unstable and unreliable. The contact between pin 210 in the USB3 sub-body and pin 213 in the USB3 main body would also become unstable and unreliable due to the constant stress pressing between the pair of pins.

Accordingly, what is desired is to provide a system and method that overcomes the above issues. The present invention addresses such a need.

SUMMARY OF THE INVENTION

A first objective of the invention is to achieve the benefits of eliminating an external USB3 device connector and to accommodate more real estate or space for the circuitry inside the USB3 device.

A second objective is make the manufacturing process simple and to save cost by eliminating soldering of the USB3 device sub-body to the main body.

A third objective is to make the contact mechanism between the USB3 host connector and the USB3 device simple and therefore effectively result in saving the USB3 device cost.

A fourth objective of the invention is to reduce or eliminate the constant stress on any contact pins between the USB3 device and the USB3 host connector and therefore extend the reliability of the device and host connector.

The present invention includes a USB3 device with solderless USB3 connector interfaces, which comprises: a USB3 device main body that houses a carrier body made of rigid material; four interface pins in the outer row that conform to the USB2.0 standard; five interface pins in the inner row that conform to the USB3.0 standard; and a substrate and electronic circuitry; and a USB3 device sub-body that houses: a carrier body made of rigid material; and five interface pins that conform to the USB3.0 standard wherein each interface pin has an upper convex part and a lower concave part; the upper convex part and the lower concave part forms a spring coil pin; and the spring coil pin can withstand multiple times of compression; a top casing; a bottom casing; and a case assembly.

Other aspects and advantages of the present invention will become apparent from the following detailed description, taken in conjunction with the accompanying drawings, illustrating by way of example the principles of the invention.

DETAILED DESCRIPTION OF THE INVENTION

The present invention relates generally to computing devices and more particularly to USB devices utilized with such computing devices. The following description is presented to enable one of ordinary skill in the art to make and use the invention and is provided in the context of a patent application and its requirements. Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

Figure 1A:
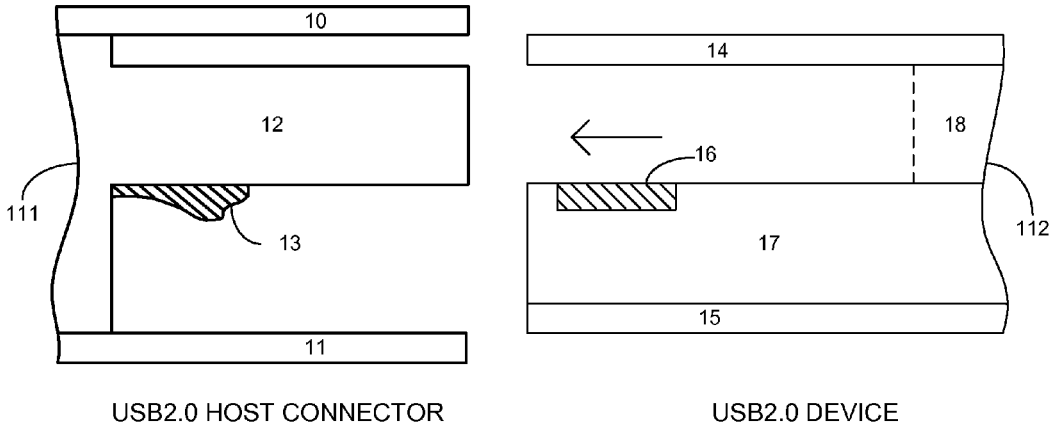
FIGS. 1A and 1B illustrate a first conventional embodiment of USB2.0 and USB3.0 host connectors and devices (cross section view).
Figure 1B:
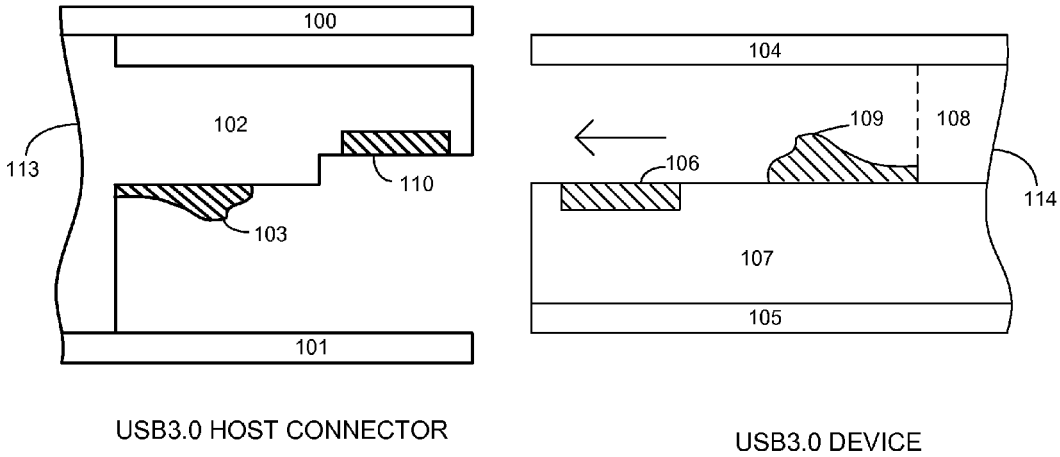
Figure 2A:
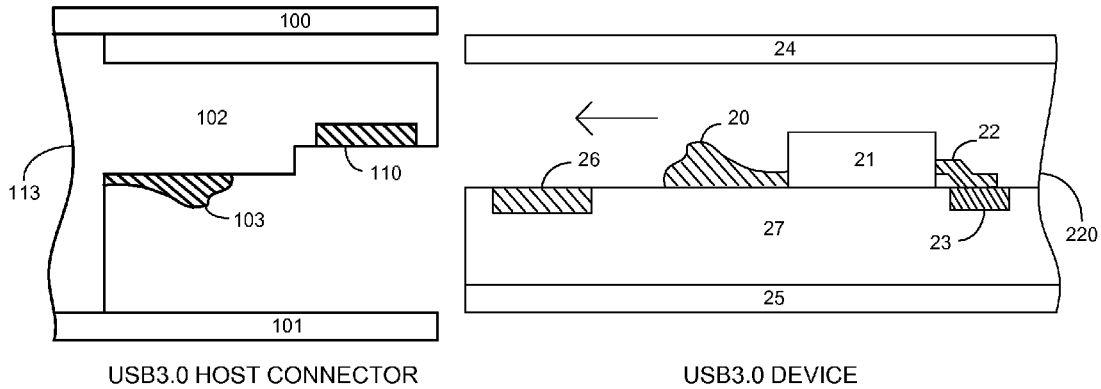
FIGS. 2A-2C illustrate a second, third and fourth conventional embodiment of USB3.0 host connectors and devices (cross section view).
Figure 2B:
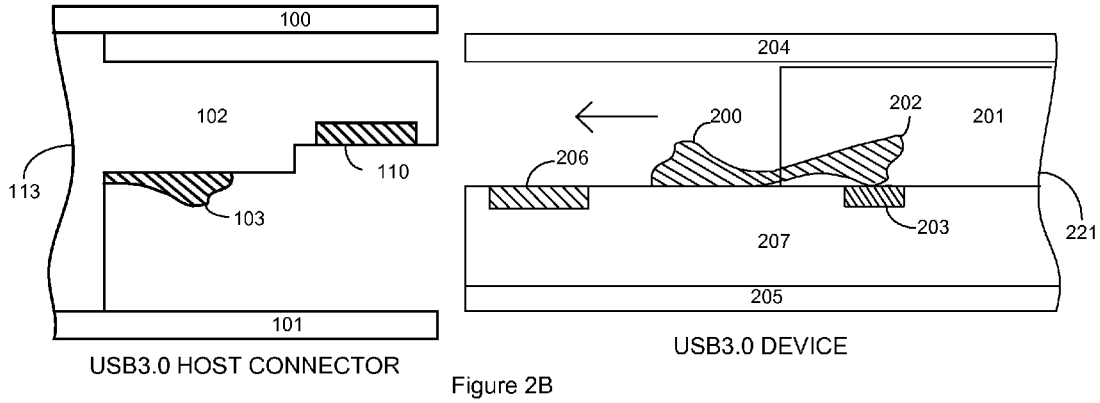
Figure 2C:
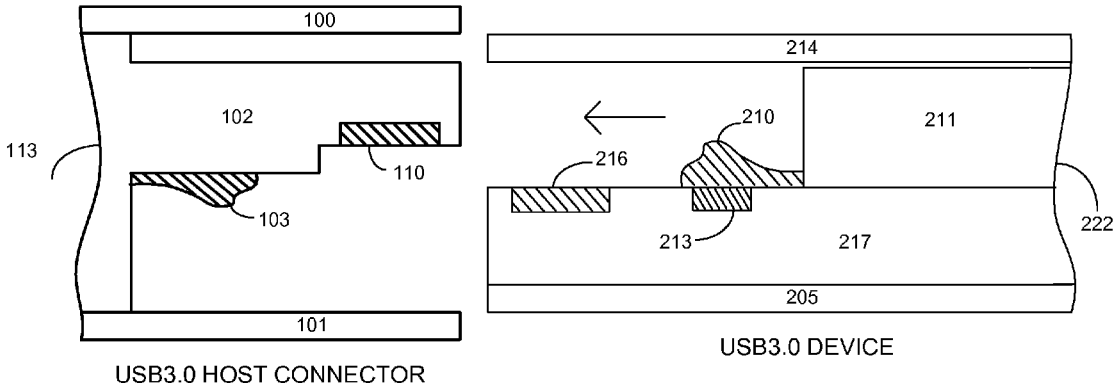
Figure 3A:
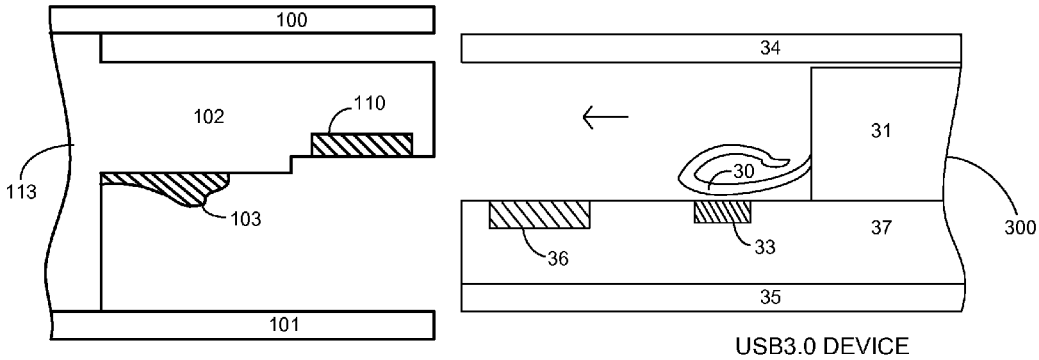
FIGS. 3A-3C illustrate a USB3.0 host connector and a USB3.0 device with convex and concave parts in a spring coil pin (cross section view) in accordance with the present invention.
Figure 3B:
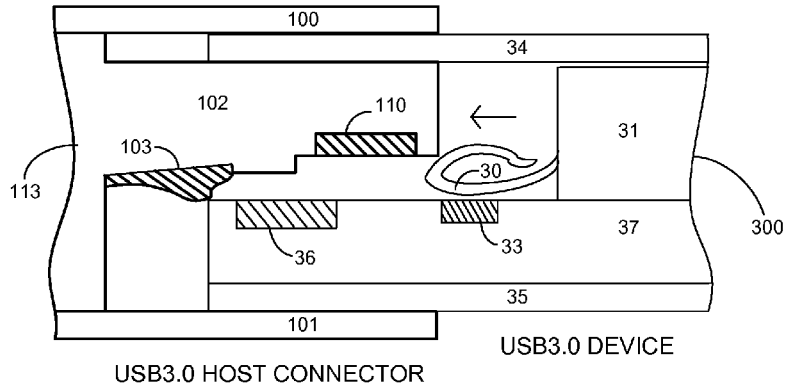
Figure 3C:
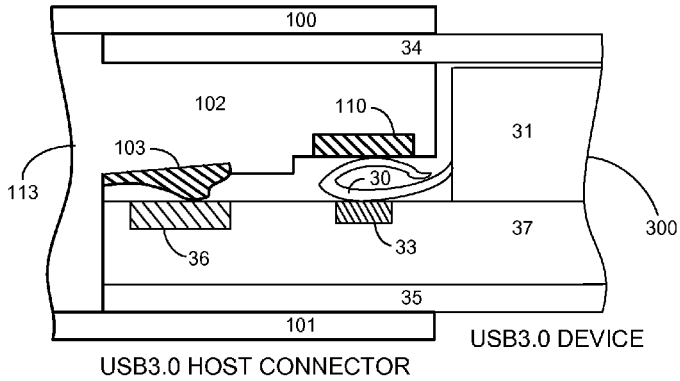

As shown in FIGS. 3A-3C, a first objective of the invention is to achieve the benefits of eliminating an external USB3 device connector and accommodate more real estate or space for the circuitry inside the USB3 device. A second objective is to make the manufacturing process simple and to save cost by eliminating soldering of the USB3 device sub-body 31 to the main body 37. A third objective is to make the contact mechanism between the USB3 host connector and the USB3 device simple and to effectively result in saving the USB3 device cost. A fourth objective of the invention is to reduce or eliminate the constant stress on any contact pins between the USB3 device and the USB3 host connector, thereby extending the reliability of the device and host connector.

As shown in FIGS. 3A-3C and FIGS. 4A-4C, a USB3 device 300 has a top casing 34, a bottom casing 35, a main body 37, and a detachable sub-body 31. The detachable sub-body 31 is stacked on top of the main body 37.

The main body 37 houses four interface pins (not shown) in the first row and five interface pins (not shown) in the fourth row. Two of the pins 36 (in the first row) and 33 (in the third row) on the USB3 main body 37 are shown in a cross section view.

The detachable sub-body 31 houses five interface pins (not shown) in the second row. One of the pins 30 (in the second row) on the USB3 sub-body 31 is shown in a cross section view.

The pin 36 will not recede when the USB3 device 300 is plugged into the USB3 host connector 113. Its counterpart 103 in USB3 host connector 113 will recede and connect to pin 36 when the USB3 device 300 is fully plugged into the USB3 host connector 113.

The pin 110 in USB3 host connector 113 will not recede when the USB3 device 300 is plugged into the USB3 host connector 113. Its counterpart pin 30 on USB3 sub-body 31 will recede and connect to pin 110 in the USB3 host connector 113 when the USB3 device 300 is fully plugged into the USB3 host connector 113. The reason pin 30 will recede is that pin 30 has a spring coil effect and can be compressed when pressed by the USB3 host connector 113, as shown in FIGS. 3A-3C. There is also room for pin 30 to recede downward and touch pin 33, when the USB3 device 300 is plugged into the USB3 host connector 113.

By implementing the first row of four pins and the third row of five pins in the USB3 device 300, the invention achieves the first objective of eliminating an external USB3 device connector and accommodates more real estate or space for the circuitry inside the USB3 device. By introducing the stacked sub-body 31 on top of the main body 37 in the USB3 device, it also eliminates soldering of the USB3 device sub-body 31 to the main body 37 and achieves the second objective of the invention.

Pin 30 on the USB3 device sub-body 31 serves the purpose of connecting between the pin 33 (in the third row) of USB3 device main body 37 and pin 110 in the outer row of USB3 host connector 113. As shown in FIG. 3A, before the USB3 device 300 is plugged into the USB3 host connector 113, pin 30 is free of stress and makes no contact to either pin 33 or pin 110. When the front edge of USB3 device main body 37 starts touching pin 103 in the USB3 host connector, the pin 103 starts receding into the USB3 host connector main body 102, as shown in FIG. 3B. As soon as pin 30 touches the front edge of the USB3 host connector main body 102, the upper convex part of pin 30 is compressed downward. The insertion force, as the USB3 device 300 traveling inward inside the USB3 host connector 113, continues to compress the lower part of pin 30. It forces the pin 30 to touch down on pin 33 of the main body 37 of the USB3 device 300 as is shown in FIG. 3C. The upper convex part and the lower concave part of the pin 30 serve as a spring coil to withstand the compression resulting from the insertion of USB3 device 300 into the USB3 host connector 113. As soon as the USB3 device 300 is unplugged from the USB3 host connector 113, the compressed spring coil in pin 30 is released and rebounds back to its original state. The simplicity in design in the upper convex part and the lower concave part of the pin 30 achieves the third objective of this invention by making the contact mechanism between the USB3 host connector 113 and the USB3 device 300 simple, effectively resulting in saving the USB3 device cost.

Before the insertion or after unplugging of the USB3 device 300 into/from the USB3 host connector 113, the upper convex part and the lower concave part of the pin 30 remain free and do not touch any other part of the USB3 device 300 or USB3 host connector 113. The spring coil design of the pin 30 is able to compress and rebound to its original state without incurring constant stress on any other part of the USB3 device 300 or USB3 host connector 113. It therefore achieves the fourth objective of this invention by reducing or eliminating the constant stress on any contact pins between the USB3 device and the USB3 host connector, thereby extending the reliability of the device and host connector.

Figure 4A:
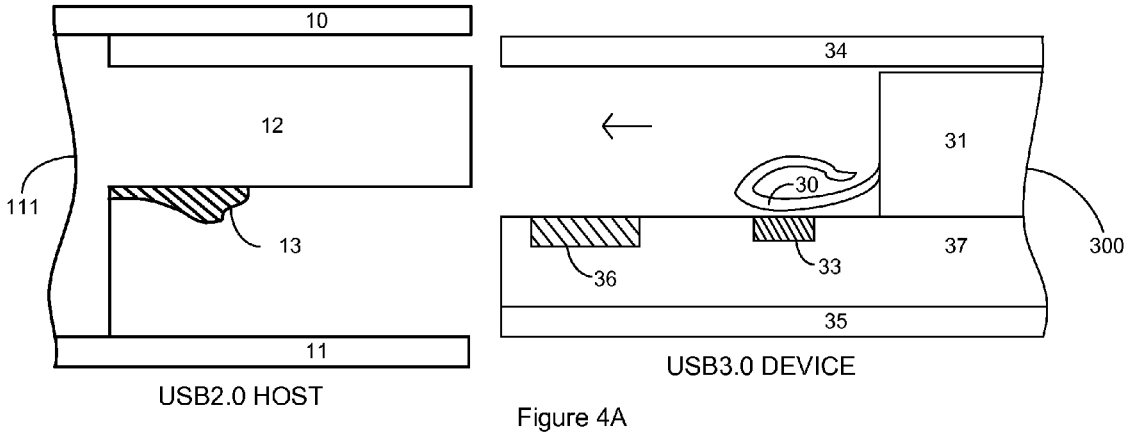
FIGS. 4A-4C illustrate a USB2.0 host connector and a USB3.0 device with convex and concave parts in a spring coil pin (cross section view) in accordance with the present invention.
Figure 4B:
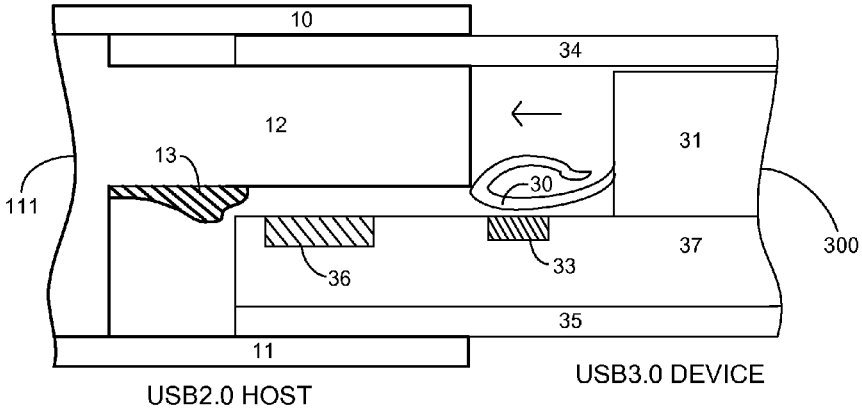
Figure 4C:
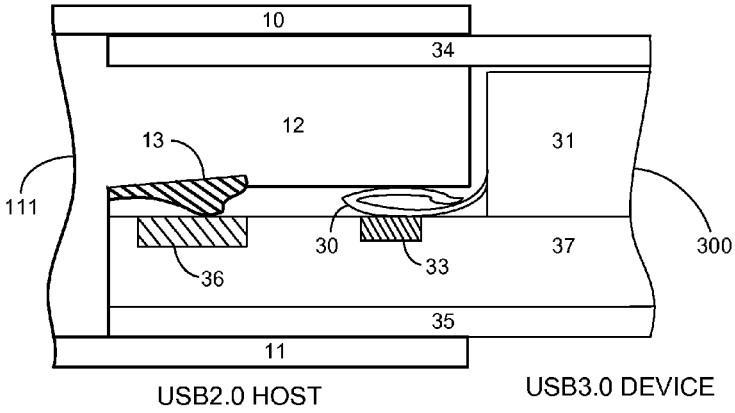

FIGS. 4A-4C depict the scenario of how a USB3 device 300 is plugged into a USB2 host connector 111. The difference between a USB3 host connector 113 and a USB2 host connector 111 lies in the fact that a USB2 host connector does not have the additional five pins in the outer row (not shown). The cross section view of the USB2 host connector 111 is show in FIGS. 4A-4C. Note that a USB2 host connector has less room for the pin 30 in a USB3 device 300 to compress once the USB3 device 300 is fully plugged into the USB2 host connector 111.

As shown in FIGS. 5A-5C and FIGS. 6A-6C, a USB3 device 500 has a top casing 54, a bottom casing 55, a main body 57, and a detachable sub-body 51. The main body 57 and the detachable sub-body 51 are stacked together.

The main body 57 houses four interface pins (not shown) in the first row and five interface pins (not shown) in the fourth row. Two of the pins 56 (in the first row) and 53 (in the third row) on the USB3 device main body 57 are shown in a cross section view. The groove 58, in a recess area of the main body 57, accommodates the five interface pins including pin 53.

The detachable sub-body 51 houses five interface pins (not shown) in the second row. One of the pins 50 (in the second row) on the USB3 device sub-body 51 is shown in a cross section view. The pin 50 has at least an upper convex part and a lower convex part that form a spring coil.

Figure 5A:
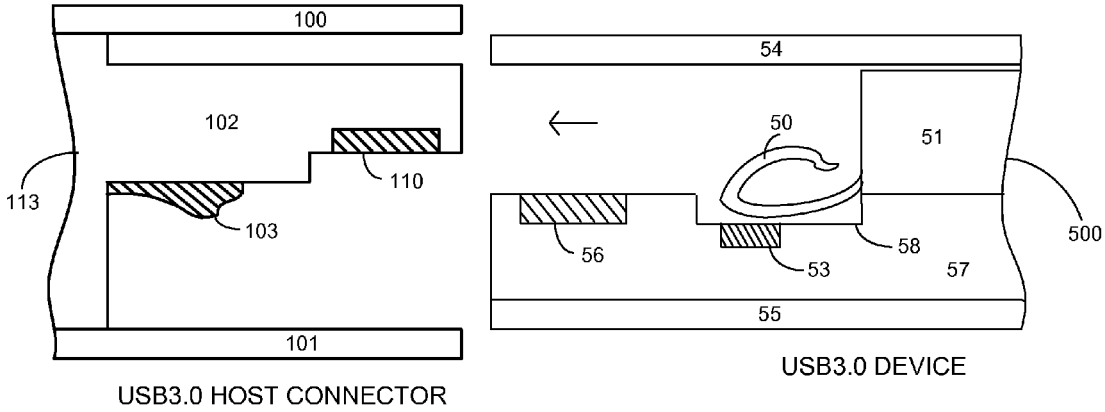
FIGS. 5A-5C illustrate a USB3.0 host connector and USB3.0 device with groove on main body (cross section view) in accordance with the present invention.
Figure 5B:
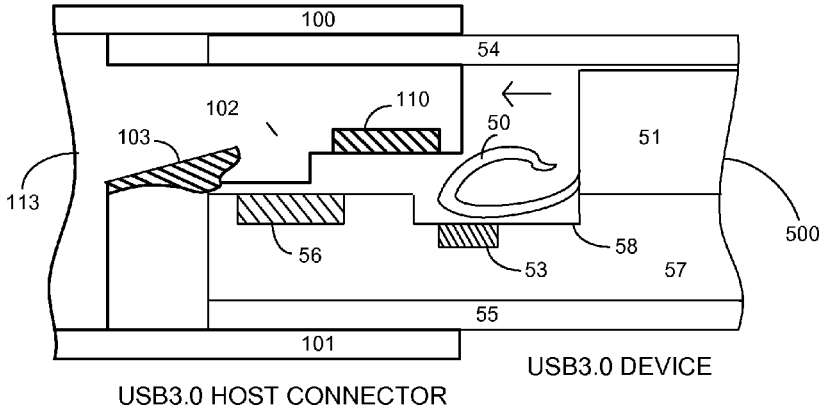
Figure 5C:
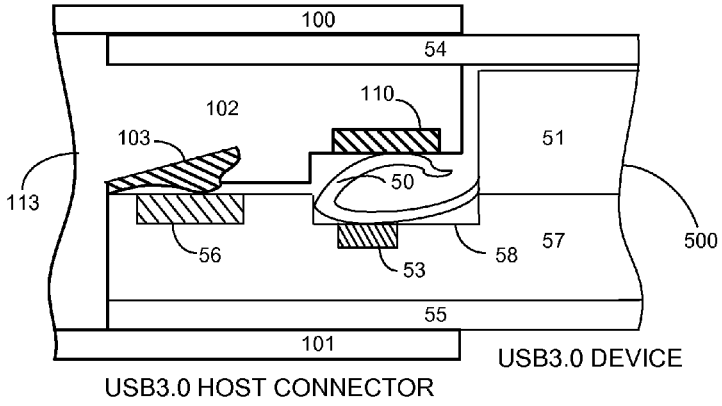

In order to let the spring coil formed by the upper convex part and the lower concave part of the pin 50 to have more room to compress and rebound, it may be beneficial to have a groove 58 in the main body 57 of the USB3 device 500. It will further enhance the fourth objective of this invention by reducing or eliminating the permanent stress on any contact pins between the USB3 device and the USB3 host connector and therefore extending the reliability of the device and host connector. The cross section view of the groove 58 is shown in FIGS. 5A-5C.

Figure 6A:
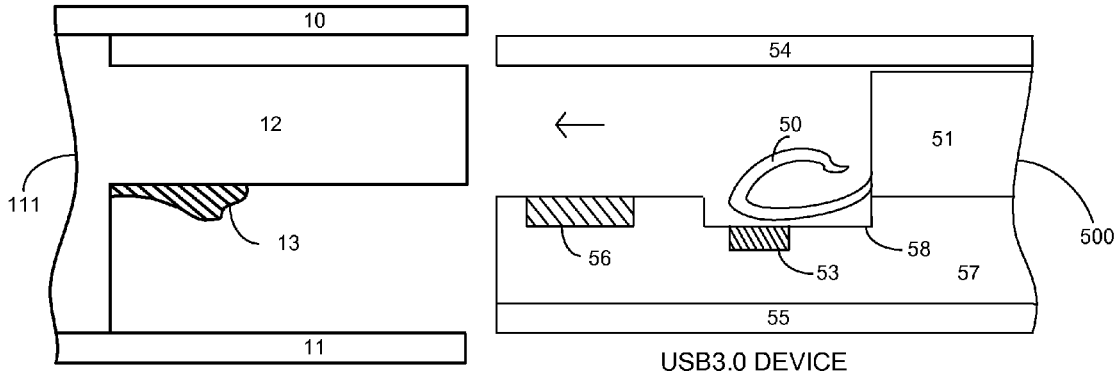
FIGS. 6A-6C illustrate a USB2.0 host connector and a USB3.0 device with groove on main body (cross section view) in accordance with the present invention.
Figure 6B:
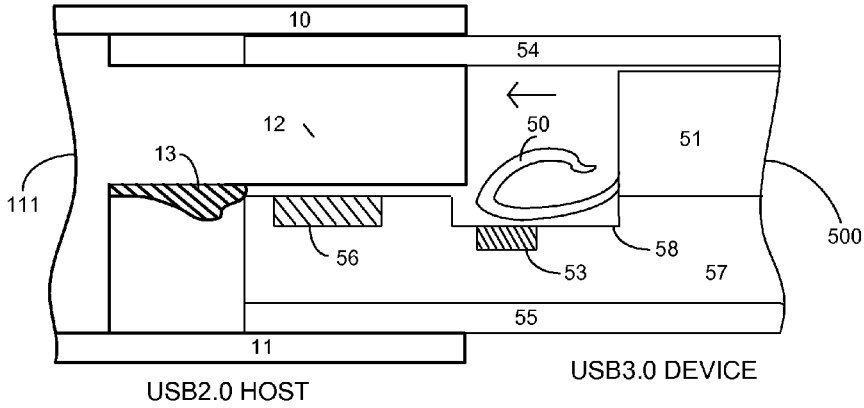
Figure 6C:
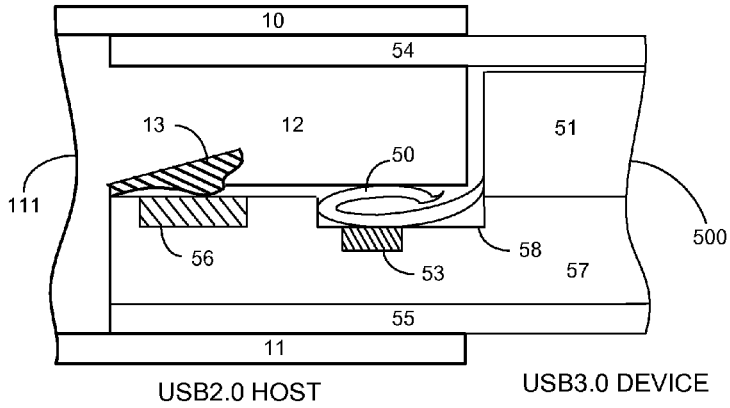
Figure 7A:
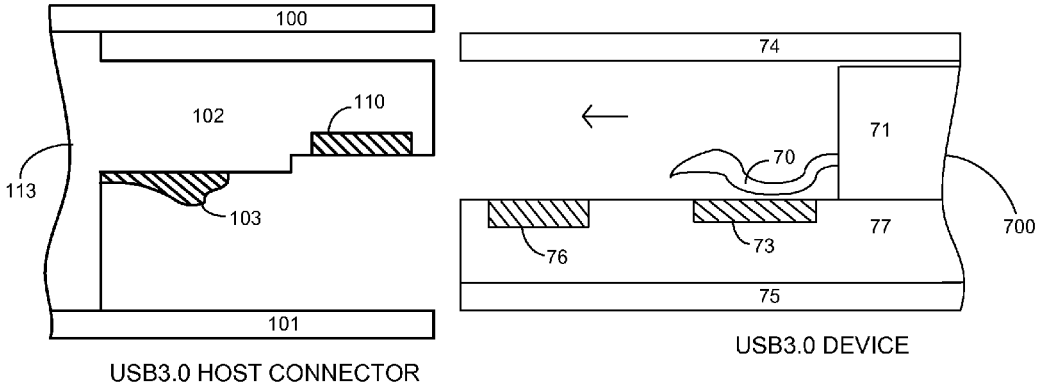
FIGS. 7A-7C illustrate a USB3.0 host connector and a USB3.0 device with convex head pin and concave part in a spring coil pin (cross section view) in accordance with the present invention.
Figure 7B:
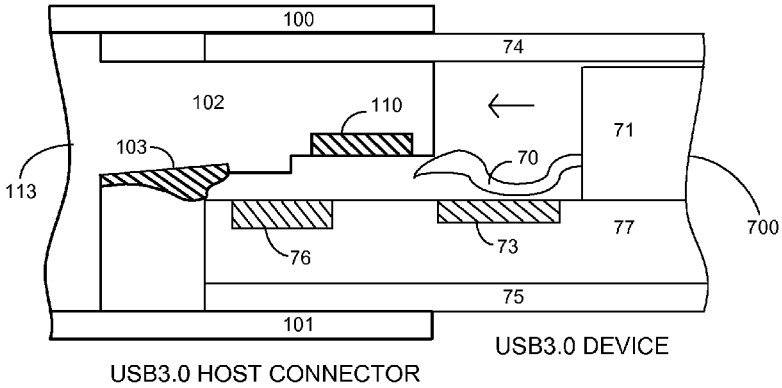
Figure 7C:
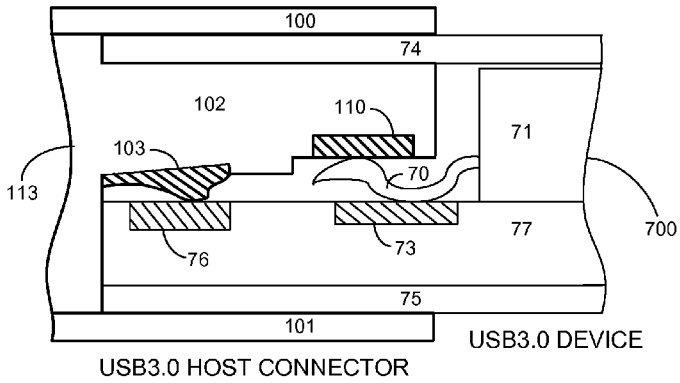

FIGS. 6A-6C depict the scenario of how a USB3 device 500 is plugged into a USB2 host connector 111. The difference between a USB3 host connector 113 and a USB2 host connector 111 lies in the fact that a USB2 host connector does not have the additional five pins in the outer row (not shown). The cross section view of the USB2 host connector 111 is show in FIGS. 6A-6C. Note that a USB2 host connector has less room for the pin 50 in a USB3 device 500 to compress once the USB3 device 500 is fully plugged into the USB2 host connector 111. It is therefore beneficial for the groove 58 in the main body 57 of the USB3 device 500 to have a proper groove depth to accommodate both scenarios in plugging into a USB3 host connector 113 and a USB2 host connector 111.

As shown in FIGS. 7A-7C and FIGS. 8A-8C, a USB3 device 700 has a top casing 74, a bottom casing 75, a main body 77, and a detachable sub-body 71. The main body 77 and the detachable sub-body 71 are stacked together.

The main body 77 houses four interface pins (not shown) in the first row and five interface pins (not shown) in the fourth row. Two of the pins 76 (in the first row) and 73 (in the third row) on the USB3 device main body 77 are shown in cross section view.

The detachable sub-body 71 houses five interface pins (not shown) in the second row. One of the pins 70 (in the second row) on the USB3 device sub-body 71 is shown in cross section view. The pin 70 has at least an upper convex part and a lower concave part that form a spring coil. This is an alternative embodiment that has a convex head pin in the upper convex part.

Figure 8A:
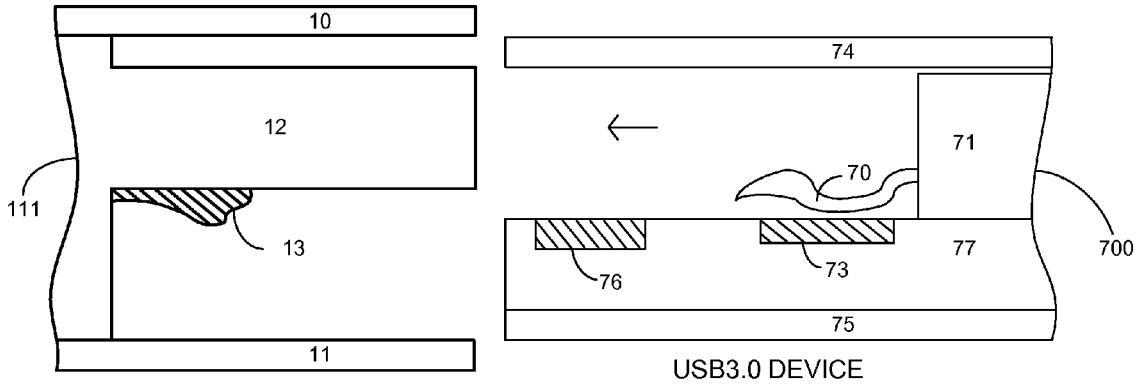
FIGS. 8A-8C illustrate a USB2.0 host connector and a USB3.0 device with convex head pin and concave part in a spring coil pin (cross section view) in accordance with the present invention.
Figure 8B:
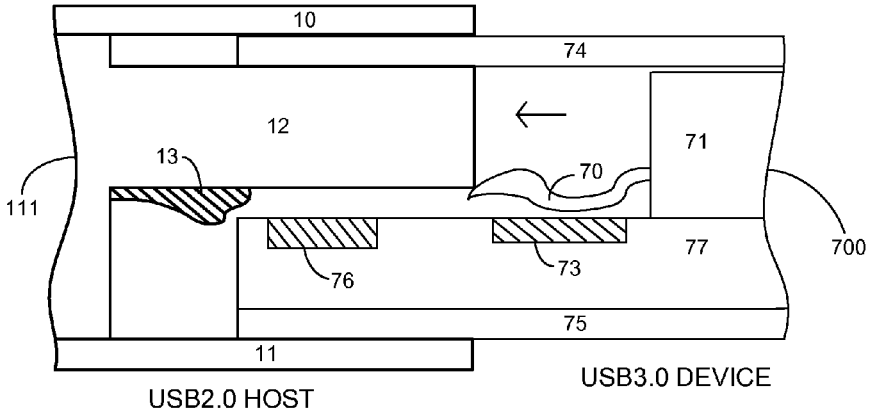
Figure 8C:
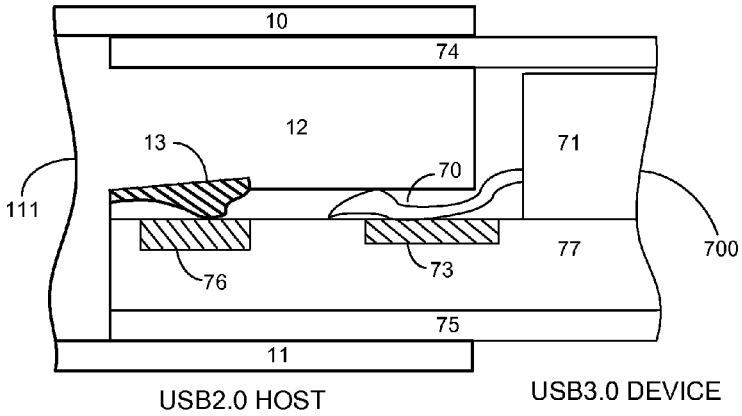
Figure 9A:
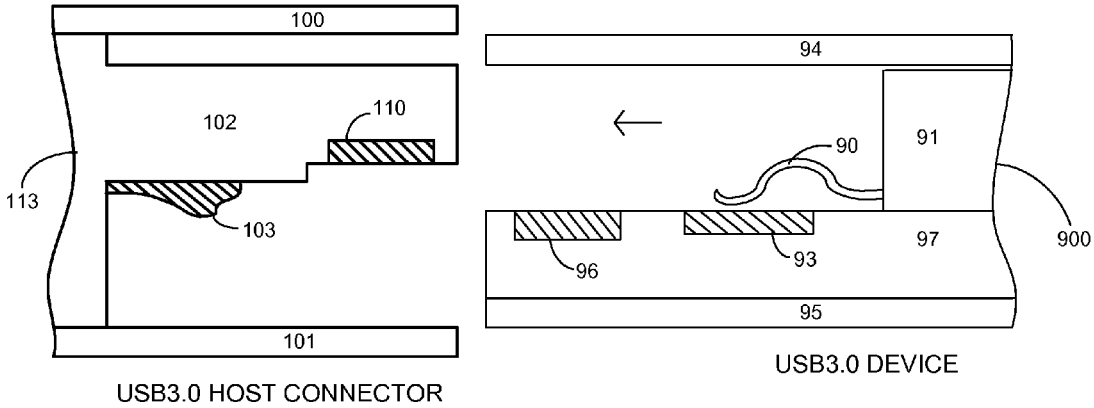
FIGS. 9A-9C illustrate a USB3.0 host connector and a USB3.0 device with convex part and concave contact tip in a spring coil pin (cross section view) in accordance with the present invention.
Figure 9B:
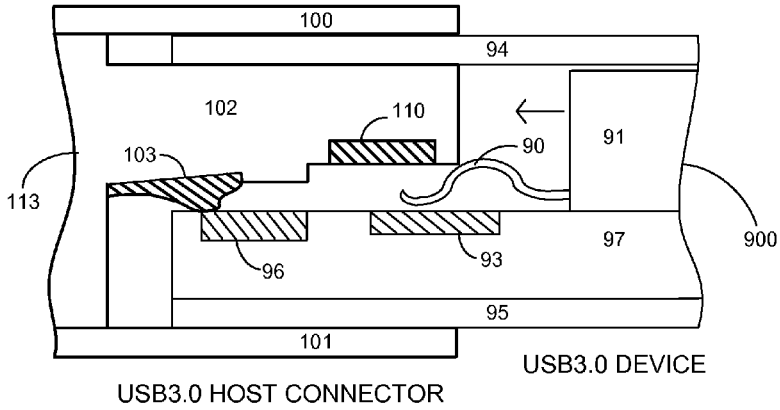
Figure 9C:
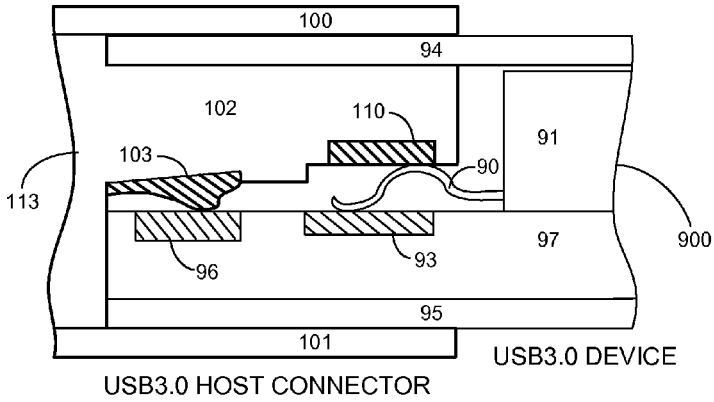

FIGS. 8A-8C depict the scenario of how a USB3 device 700 is plugged into a USB2 host connector 111. The difference between a USB3 host connector 113 and a USB2 host connector 111 lies in the fact that a USB2 host connector does not have the additional five pins in the outer row (not shown). The cross section view of the USB2 host connector 111 is show in FIGS. 8A-8C. Note that a USB2 host connector has less room for the pin 70 in a USB3 device 700 to compress once the USB3 device 700 is fully plugged into the USB2 host connector 111.

As shown in FIGS. 9A-9C and FIGS. 10A-10C, a USB3 device 900 has a top casing 94, a bottom casing 95, a main body 97, and a detachable sub-body 91. The main body 97 and the detachable sub-body 91 are stacked together.

The main body 97 houses four interface pins (not shown) in the first row and five interface pins (not shown) in the fourth row. Two of the pins 96 (in the first row) and 93 (in the third row) on the USB3 device main body 97 are shown in cross section view.

The detachable sub-body 91 houses five interface pins (not shown) in the second row. One of the pins 90 (in the second row) on the USB3 device sub-body 91 is shown in cross section view. The pin 90 has at least an upper convex part and a lower concave part that form a spring coil. This is an alternative embodiment that has a concave contact tip in the lower concave part.

Figure 10A:
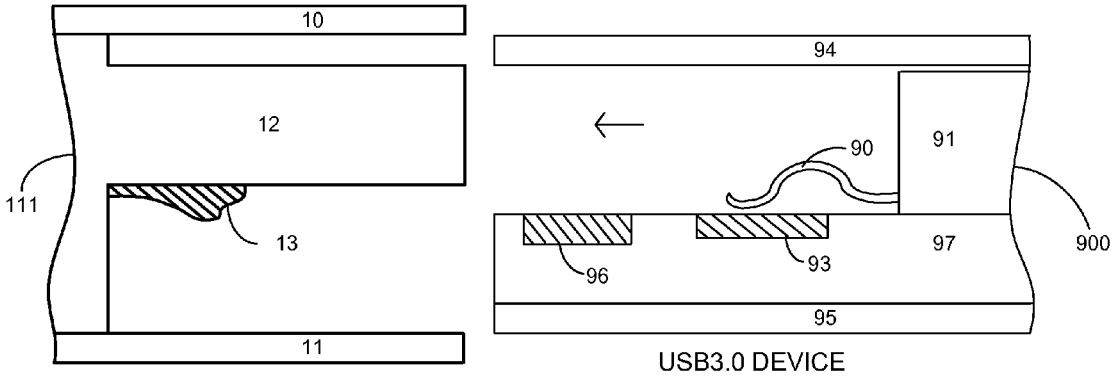
FIGS. 10A-10C illustrate a USB2.0 host connector and a USB3.0 device with convex part and concave contact tip in a spring coil pin (cross section view) in accordance with the present invention.
Figure 10B:
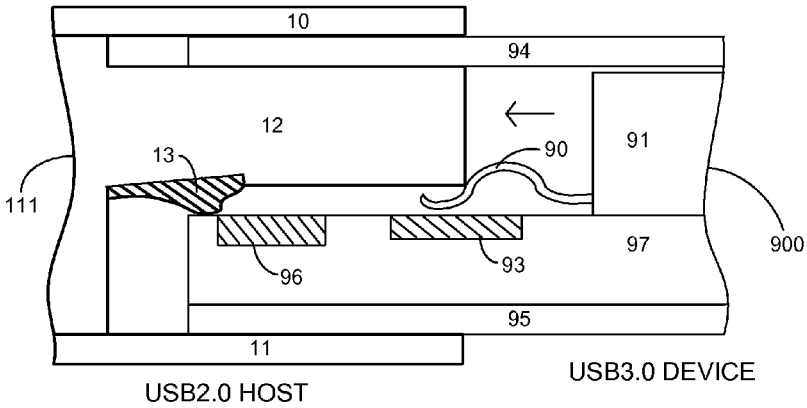
Figure 10C:
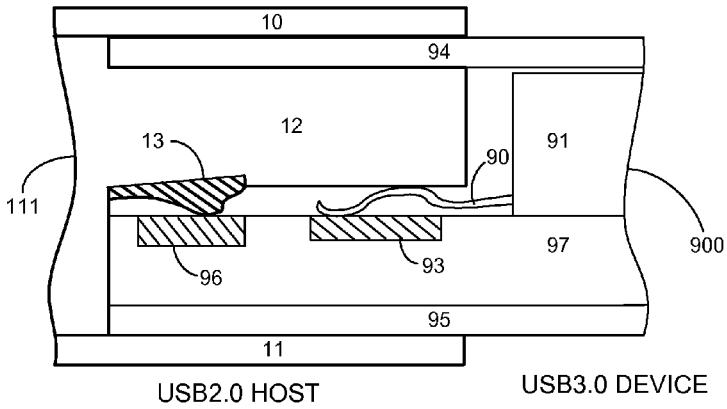

FIGS. 10A-10C depict the scenario of how a USB3 device 900 is plugged into a USB2 host connector 111. The difference between a USB3 host connector 113 and a USB2 host connector 111 lies in the fact that a USB2 host connector does not have the additional five pins in the outer row (not shown). The cross section view of the USB2 host connector 111 is show in FIGS. 10A-10C. Note that a USB2 host connector has less room for the pin 90 in a USB3 device 900 to compress once the USB3 device 900 is fully plugged into the USB2 host connector 111.

Although the present invention has been described in accordance with the embodiments shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims.

What is claimed is:

1. A USB3 device with solderless USB3 connector interface comprises:

a USB3 device main body that houses a carrier body made of rigid material; four interface pins in an outer row that conform to a USB2.0 standard; five interface pins in an inner row that conform to a USB3.0 standard; and a substrate and an electronic circuitry; and a USB3 device sub-body that houses: a carrier body made of rigid material; and five interface pins that conform to the USB3.0 standard wherein each of the interface pins has at least one upper convex part and at least one lower concave part; the at least one upper convex part and the at least one lower concave part forms a spring coil pin; and the spring coil pin can withstand multiple times of compression, wherein the at least one upper convex part compresses and connects to its corresponding pin in another outer row of a USB3 host connector when the USB3 device is plugged into the USB3 host connector; wherein the at least one upper convex part compresses and connects to no pin in a USB2 host connector when the USB3 device is plugged into the USB2 host connector; wherein the at least one lower concave part compresses and connects to its corresponding pin in the inner row of the USB3 device when the USB3 device is plugged into a USB host connector; wherein when the USB3 device is unplugged from the USB host connector, the spring coil pin rebounds to its original state and is free from making contact with either a corresponding pin in the USB host connector or a corresponding pin in the USB3 device;

a top casing;

a bottom casing; and a case assembly.

2. The USB3 device of claim 1, wherein an assembly binds a top casing, a bottom casing, the USB3 device main body and the USB3 device sub-body to complete the USB3 device; and wherein the USB3 device sub-body stacks on top of the USB3 device main body with no need for soldering between the main body and the sub-body, wherein the top casing forms a top protective part of the USB3 device and the bottom casing forms a bottom protective part of the USB3 device.

3. The USB3 device in claim 1, which includes a groove in the USB3 main body to accommodate the five interface pins.

4. The USB3 device of claim 1, wherein the at least one upper convex part of the five spring coil pins in the USB3 device sub-body compress and connect to their corresponding pins in a pair in the outer row of the USB3 host connector when the USB3 device is plugged into the USB3 host connector;

the at least one lower concave part of the five spring coil pins in the USB3 device sub-body compress and connect to their corresponding pins in a pair in the inner row of the USB3 device when the USB3 device is plugged into the USB3 host connector;

the five spring coil pins compress and connect the five pair of pins between the outer row of the USB3 host connector and the inner row of the USB3 device when the USB3 device is plugged into the USB3 host connector;

the four pins in the outer row of the USB3 device connect to the four corresponding pins in a pair in the inner row of the USB3 host connector when the USB3 device is plugged into the USB3 host connector; and as soon as the USB3 device is unplugged from the USB3 host connector, the spring coil pin rebounds to its original state and is free from making contact with either the corresponding pin in the USB3 host connector or the corresponding pin in the USB3 device.

5. The USB3 device of claim 1, wherein the at least one upper convex part of at least one of the interface pins is comprised of a convex spring coil.

6. The USB3 device of claim 1, wherein the at least one upper convex part of at least one of the interface pins is comprised of a convex head pin.

7. The USB3 device of claim 1, wherein the at least one lower concave part of at least one of the interface pins is comprised of a concave contact tip.

8. A USB3 system comprising:

a USB3 host connector, which comprises:

a main body made of rigid material, four interface pins in an outer row that conform to a USB2.0 standard and;

five interface pins in an inner row that conform to a USB3.0 standard and;

a USB device, which comprises:

a USB3 device main body that houses a carrier body made of rigid material; four interface pins in another outer row that conform to the USB2.0 standard; five interface pins in another inner row that conform to the USB3.0 standard; and a substrate and electronic circuitry; and a USB3 device sub-body that houses: another carrier body made of rigid material; and five interface pins that conform to the USB3.0 standard wherein each of the interface pins has at least one upper convex part and at least one lower concave part; the at least one upper convex part and the at least one lower concave part forms a spring coil pin; and the spring coil pin can withstand multiple times of compression, wherein the at least one lower concave pin compresses and connects to its corresponding pin in the inner row of the USB3 device when the USB3 device is plugged into a USB host connector; wherein when the USB3 device is unplugged from the USB host connector, the spring coil pin rebounds to its original state and is free from making contact with either a corresponding pin in the USB host connector or a corresponding pin in the USB3 device; the top casing; the bottom casing, wherein the USB3 main body is made of rigid material; and the four interface pins in the inner row conform to the USB2.0 and USB3.0 standard; and the five interface pins in the outer row conform to the USB3.0 standard;

a top casing;

a bottom casing; and a case assembly.

9. A USB2 system comprising:

a USB2 host connector, which comprises:

a main body made of rigid material, four interface pins in an inner row that conform to a USB2.0 standard and;

a USB device, which comprises:

a USB3 device main body that houses a carrier body made of rigid material; four interface pins in an outer row that conform to the USB2.0 standard; five interface pins in another inner row that conform to a USB3.0 standard; and a substrate and electronic circuitry; and a USB3 device sub-body that houses: another carrier body made of rigid material; and five interface pins that conform to the USB3.0 standard wherein each of the interface pins has at least one upper convex part and at least one lower concave part; the at least one upper convex part and the at least one lower concave part forms a spring coil pin; and the spring coil pin can withstand multiple times of compression, wherein the at least one lower concave pin compresses and connects to its corresponding pin in the inner row of the USB3 device when the USB3 device is plugged into a USB host connector; wherein when the USB3 device is unplugged from the USB host connector, the spring coil pin rebounds to its original state and is free from making contact with either a corresponding pin in the USB host connector or a corresponding pin in the USB3 device; the top casing; the bottom casing, wherein the USB3 main body is made of rigid material; and the four interface pins in the inner row conform to the USB2.0 and USB3.0 standard; and the five interface pins in the outer row conform to the USB3.0 standard;

a top casing;

a bottom casing; and a case assembly.

* * * * *